US005301568A

United States Patent [19]

Kono

[11] Patent Number: 5,301,568

[45] Date of Patent: Apr. 12, 1994

[54] STICK LEVER DEVICE

[75] Inventor: Toru Kono, Mobara, Japan

[73] Assignee: Futaba Denshi Kogyo K.K., Mobara, Japan

[21] Appl. No.: 926,178

[22] Filed: Aug. 7, 1992

[30] Foreign Application Priority Data

Aug. 9, 1991 [JP] Japan ..... 3-070674

[51] Int. Cl.[5] ..... G05G 5/05

[52] U.S. Cl. ..... 74/525; 74/491; 267/150; 338/68

[58] Field of Search ..... 74/491, 522, 523, 525; 267/150; 338/68

[56] References Cited

U.S. PATENT DOCUMENTS 2,108,745 2/1938 Dodd ..... 74/525
2,960,199 11/1960 Morse ..... 74/525 X
4,490,710 12/1984 Kopsho, Jr. et al. ..... 267/150 X

*Primary Examiner*—Allan D. Herrmann
*Attorney, Agent, or Firm*—Oblon, Spivak, McClelland, Maier & Neustadt

[57] ABSTRACT

A stick lever device including a mechanism for shifting a neutral position and capable of decreasing the number of parts of the device and facilitating the assembling. A pivotal shaft of a variable resistor mounted on a mounting member is securely mounted with a pivotal operation section including a stick lever. The mounting member is formed with two shaft holes and a support shaft of an arm member is selectively fitted in any one of the shaft holes. The pivotal operation section is provided thereon with three projections. The arm member which is urged by a spring is abutted against predetermined two of the projections depending on the position of the support shaft of the arm member, so that the neutral position of the pivotal operation section and stick lever may be shifted as desired.

5 Claims, 4 Drawing Sheets

STICK LEVER DEVICE

BACKGROUND OF THE INVENTION

This invention relates to a stick lever device adapted to control a resistance value of a variable resistor in response to operation of a stick lever, and more particularly to an improvement in a mechanism for automatically returning a stick lever. The present invention may be applied to a radio control system for carrying out remote control of a controlled model depending on the amount of operation of the stick lever.

In general, a radio control device for remotely controlling movement of a controlled model such as a model car, a model boat, a model airplane, a model helicopter or the like includes a transmitter which is provided with a stick lever device for controlling a resistance value of a variable resistor in response to the amount of operation of the stick lever. Then, the stick lever device controls electrical radiation transmitted from the transmitter to control the amount of driving of a servo mechanism or the like mounted on the controlled model, resulting in controlling a speed of traveling of the controlled model, a direction thereof and the like.

The stick lever device is generally provided with a mechanism for automatically returning the stick lever. The mechanism is adapted to automatically return the stick lever to a predetermined neutral position when an operator releases the stick lever.

Also, for example, when a model car is to be forward and rearward moved, it is not required to control a speed at which the model car is rearward driven over a wide range as compared with that at which it is forward driven. This is true of a model boat. A model airplane does not require its rearward movement. For these reasons, a mechanism is often provided which is adapted to vary the neutral position of the stick lever in the stick lever device depending on the magnitude of operation of the stick lever required depending on the type of a controlled model.

Now, a conventional stick lever device which is provided with a mechanism for varying a neutral position of a stick lever will be described hereinafter with reference to FIG. 3 and FIGS. 4(*a*) and 4(*b*).

The mechanism includes a mounting member 100 which is mounted thereon with a variable resistor 103 through a trim lever 101 and a seat plate 102. The variable resistor 103 includes a revolving shaft 104 rotatably supported on a side of the mounting member 100. The revolving shaft 104 is fixedly mounted thereon with a drum 105, which includes a stick lever 106, so that operation of the stick lever 106 permits the revolving shaft 104 to be pivotally moved. The mounting member 100 is also provided with a change-over lever 107, which is adapted to be pivotally moved about the revolving shaft 104 and selectively held in two different positions on a side of the mounting member 100 by means of a pair of pawls 108. The change-over lever 107 is mounted with an arm member 109, which is supported at one end thereof on one end of the change-over lever 107 and mounted at the other end thereof on the other end of the change-over lever 107 through a spring 110. The arm member 109 is abutted at a central portion thereof against two projections 111 and 112 provided on a side surface of the drum 105 by means of the spring 110.

The arm member 109, as shown in FIG. 4(*a*), urges the projections 111 and 112 provided on the drum 105 by force of a predetermined magnitude, so that the drum 105 and stick lever 106 each are set at a predetermined neutral position. As shown in FIG. 4(*b*), tilting of the arm member 109 due to operation of the change-over lever 107 causes a position at which each of the drum 105 and stick lever 106 is kept stationary to be varied correspondingly.

Unfortunately, the conventional stick lever device is complicated in structure, increased in the number of parts of the device and troublesome in assembling.

SUMMARY OF THE INVENTION

The present invention has been made in view of the foregoing disadvantage of the prior art.

Accordingly, it is an object of the present invention to provide a stick lever device which is capable of being simplified in structure and decreased in the number of parts of the device.

It is another object of the present invention to provide a stick lever device which is capable of shifting a neutral position by a simple operation.

In accordance with the present invention, a stick lever device is provided. The stick lever device includes a mounting member, a variable resistor including a pivotal shaft and mounted on the mounting member, and a pivotal operation section including a stick lever and arranged on the pivotal shaft of the variable resistor. The pivotal operation section is provided on a side surface thereof with a plurality of projections. The stick lever device also includes an arm member abutted against the projections by force of a predetermined magnitude to return the pivotal operation section to a predetermined neutral position. The arm member is selectively pivotally mounted on the mounting member at any one of different positions so that abutment between the arm member and the projections may be varied to permit the neutral position of the pivotal operation section to be shifted as desired.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
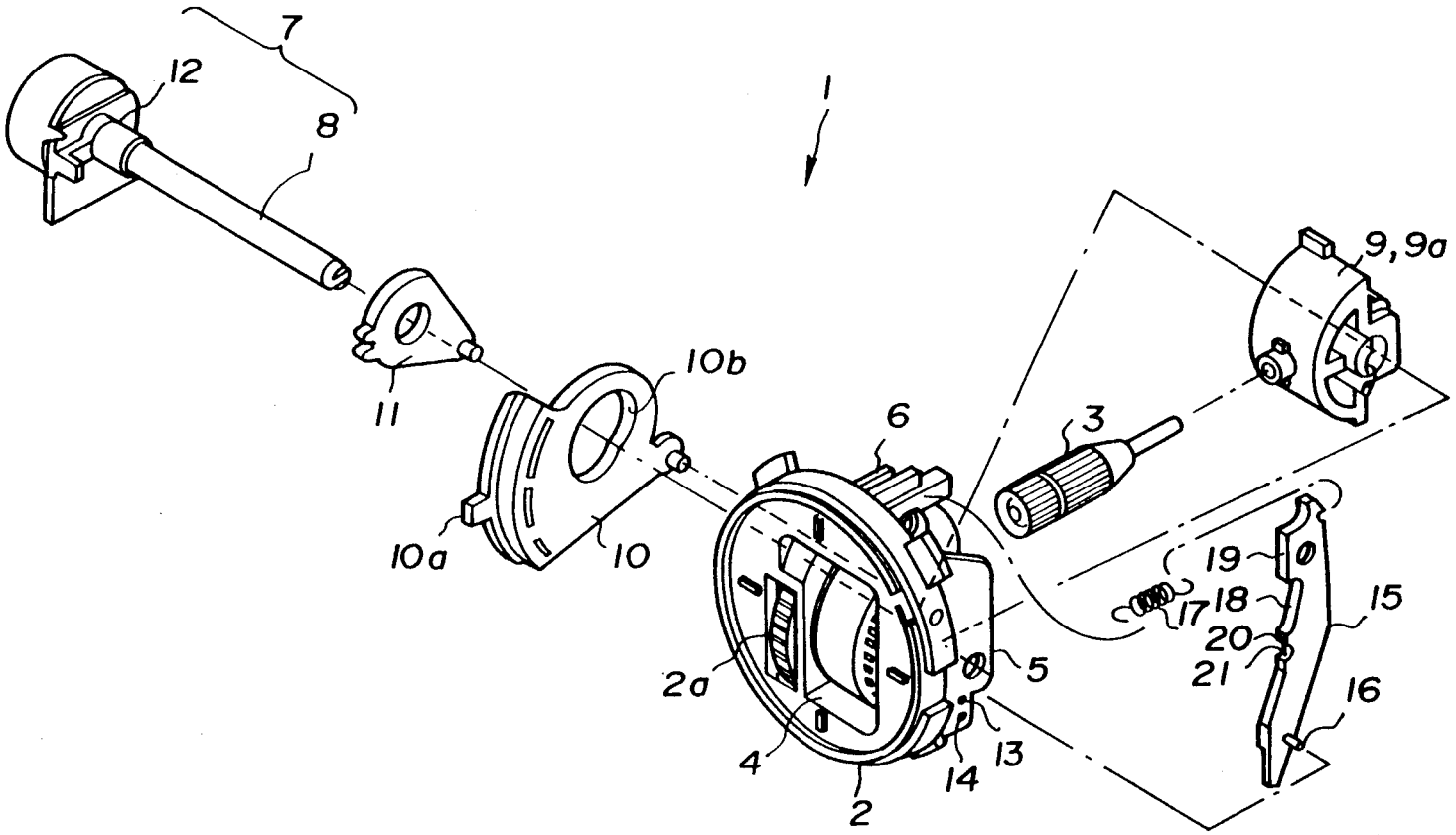
FIG. 1 is an exploded perspective view showing an embodiment of a stick lever device according to the present invention.

Now, a stick lever device according to the present invention will be described hereinafter with reference to FIGS. 1 and 2, wherein like reference numerals designate like parts throughout.

Figure 2A:
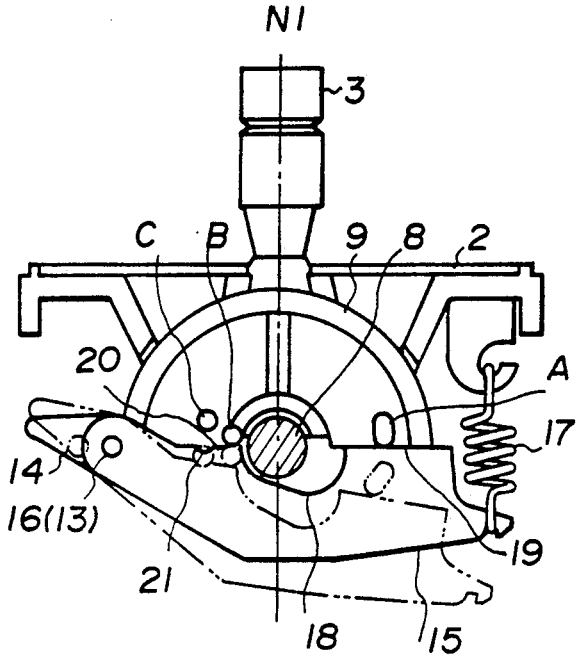
FIG. 2(*a*) and 2(*b*) are sectional views showing the manner of operation of the stick lever device of FIG. 1.
Figure 2B:
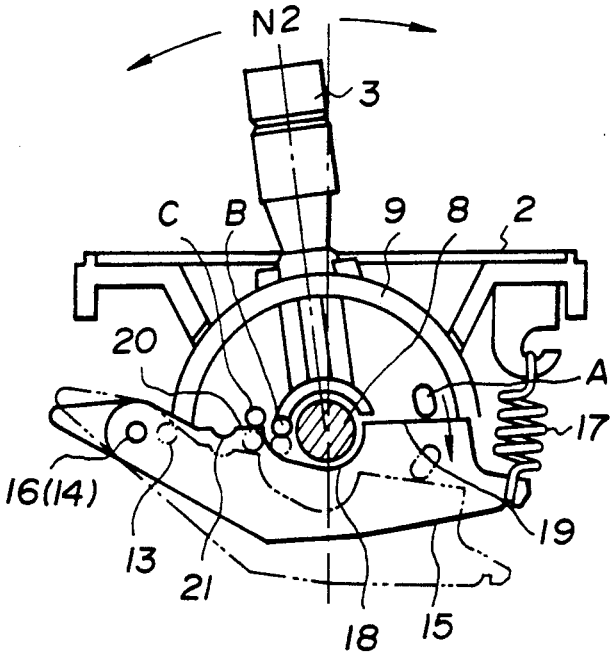
Figure 3:
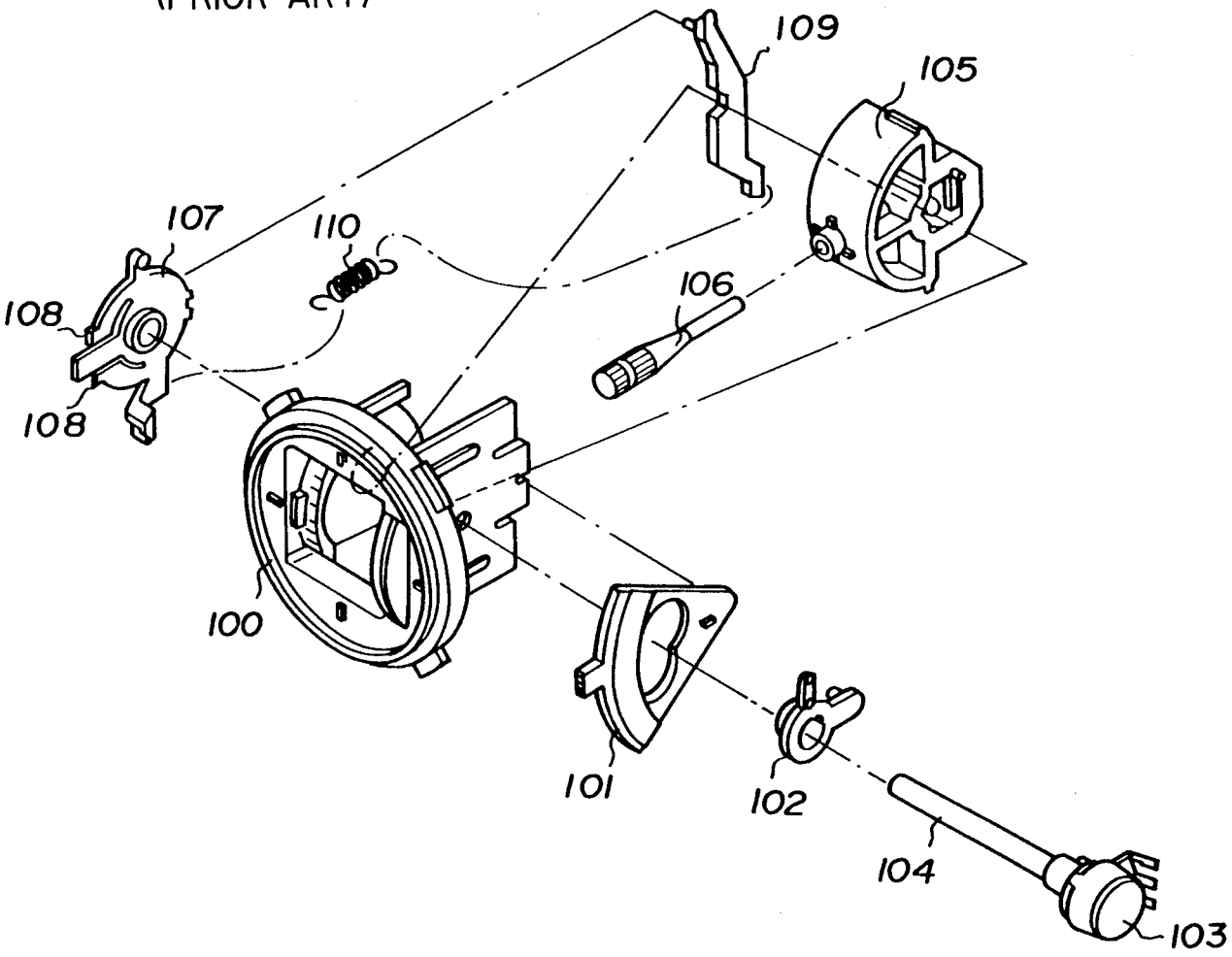
FIG.3 (PRIOR ART)
FIG. 3 is an exploded perspective view showing a conventional stick lever device.
Figure 4A:
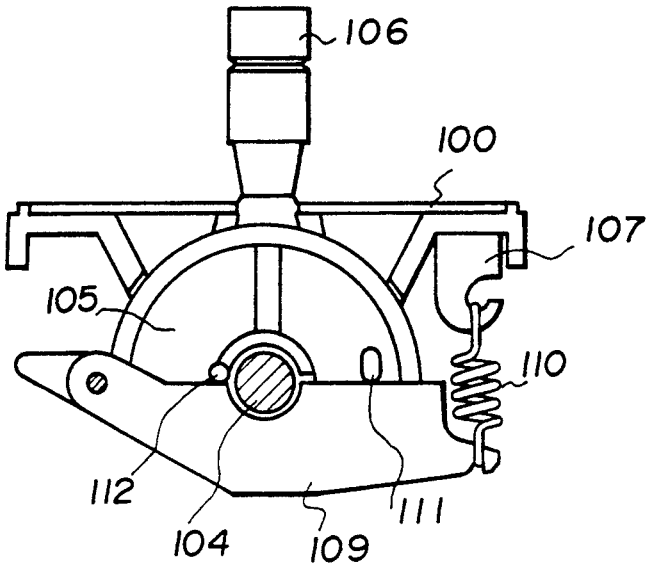
FIG.4(a) (PRIOR ART)
FIGS. 4(*a*) and 4(*b*) are a sectional view showing the manner of operation of the conventional stick lever device shown in FIG. 3.
Figure 4B:
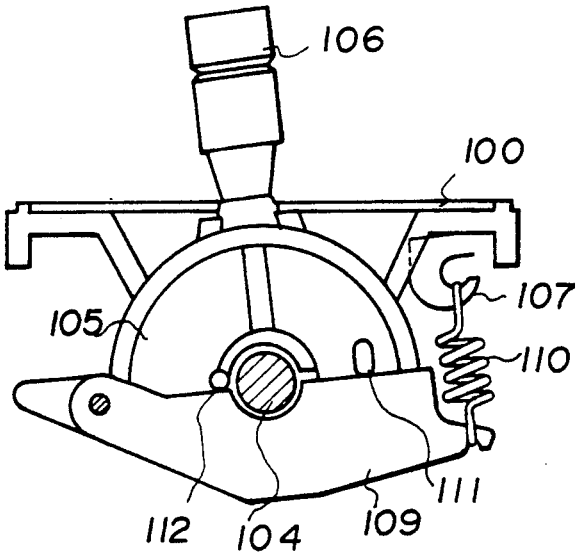
FIG.4(b) (PRIOR ART)

FIGS. 1, 2(*a*) and 2(*b*) illustrate an embodiment of a stick lever device according to the present invention. A stick lever device of the illustrated embodiment which is generally designated at reference numeral 1 includes a mounting member 2, which may be mounted on a body of a radio control transmitter or the like. The mounting member 2 is formed at a central portion thereof with a through-hole 4, via which a stick lever 3 is projected. The mounting member 2 is also provided on a rear side thereof with a pair of mounting brackets 5 and 6 with the through-hole 4 being interposed therebetween.

The mounting member 2 is mounted thereon with a variable resistor 7, which includes a pivotal shaft 8. The pivotal shaft 8 is arranged so as to be inserted through the mounting brackets 5 and 6, and a pivotal operation section 9 of a semi-cylindrical shape arranged between the mounting brackets 5 and 6. The pivotal operation section 9 is fixedly mounted on the pivotal shaft 8 and is so arranged so that a side of a circumferential surface 9*a* thereof on which the stick lever 3 is fixed is externally exposed via the through-hole 4 of the mounting member 2. The pivotal operation section 9 is pivotally moved through the stick lever 3, resulting in the pivotal shaft 8 of the variable resistor 7 being pivotally moved.

One of the brackets of the mounting member 2 or the bracket 6 is swingably or pivotally mounted with a trim lever 10, which includes an operation section 10*a* arranged so as to forwardly project through a slit 2*a* of the mounting member 2. The trim lever 10 is swingably mounted with a seat plate 11. The variable resistor 7 includes a resistor body 12 which is mounted on the seat plate 11 and engagedly fitted in a guide hole 10*b* of the trim lever 10. Thus, oscillation of the trim lever 10 permits the body 12 of the movable resistor 7 to be pivotally moved within a predetermined angular range with respect to the pivotal shaft 8.

The other bracket 5 of the mounting member 2 is formed at one end thereof with a pair of shaft holes 13 and 14 in a manner to be spaced from each other at a predetermined interval in a direction of oscillation of the stick lever 3.

The stick lever device 1 of the illustrated embodiment also includes an arm member 15 arranged between the mounting bracket 5 of the mounting member 2 and the pivotal operation section 9, so that pressing of the pivotal operation section 9 permits the stick lever 3 to be set at a neutral position.

The arm member 15 is provided at a proximal end thereof with a support shaft 16, which is adapted to be selectively engagedly fitted in one of the shaft holes 13 and 14. The arm member 15 is connected at a distal end thereof to the mounting member 2 by means of a spring 17.

The arm member 15 is formed on a side thereof facing the mounting member 2 with a first relief 18 for the pivotal shaft 8. Also, the arm member 15 is formed with two abutments 19 and 20 in a manner to be aligned on a straight line with the relief 18 being interposed therebetween. Further, the arm member 15 is formed with a second relief 21, which is positioned between the support shaft 16 and the abutment 20 arranged in proximity to the support shaft 16.

The pivotal operation section 9 is provided on a side thereof facing the arm member 15 with three projections A, B and C, which are adapted to be abutted against the abutments 19 and 20 by elastic force of the spring 17.

More particularly, the projection A, as shown in FIG. 2(*a*), is arranged in proximity to the distal end of the arm member 15 as compared with the pivotal shaft 8 on a neutral position N of the stick lever 3, so that the projection A may be abutted against the abutment 19 of the arm member 15 whether the arm member 15 is rotated about the shaft hole 13 or shaft hole 14.

The projections B and C each are arranged in proximity to the proximal end of the arm member 15 as compared with the pivotal shaft 8 on the basis of the neutral position N of the stick lever 3. The projection B is arranged in proximity to the pivotal shaft 8 as compared with the projection C. A line formed by connecting the projection B and projection A to each other is defined so as to be parallel to a line formed by connecting the two abutments 19 and 20 of the arm member 15 to each other and perpendicular to a center line of the stick lever 3. Further, the projection C arranged away from the pivotal shaft 8 is deviated from the line between the projections A and B.

Thus, as shown in FIG. 2(*a*), when the support is engagedly fitted in the shaft hole 13 arranged in proximity to the pivot shaft 8, the projection B is abutted against the abutment 20 and the projection C is rendered opposite to the second relief 21, so that the projection C is prevented from being contacted with the arm member 15 when the stick lever 3 is pivotally moved toward the projection C. Also, as shown in FIG. 2(*b*), when the support shaft 16 is fitted in the shaft hole 14 arranged away from the pivotal shaft 8, the projection B is caused to be opposite to the first relief 18 and the projection C is abutted against the abutment 20. When the stick lever 3 is pivotally moved, the relief 18 prevents the projection B from being contacted with the arm member 15.

Now, the manner of operation of the stick lever device 1 of the illustrated embodiment constructed as described above will be described hereinafter.

As shown in FIG. 2(*a*), the support pin shaft of the arm member 15 is engagedly fitted in the shaft hole 13 arranged in proximity to the pivotal shaft 8. At this time, the abutments 19 and 20 of the arm member 15 are abutted against the projections A and B by the spring 17, respectively. The projection C is kept separated from the arm member 15. This results in a central position of the stick lever 3 being defined to be a neutral position N1, so that it may be operated in the same amount in either direction.

As shown in FIG. 2(*b*), the support shaft 16 of the arm member 15 is fitted in the shaft hole 14. At this time, the spring 17 causes the abutments 19 and 20 of the arm member 15 to be abutted against the projections A and C, respectively. This results in each of the pivotal operation section 9 and stick lever 3 taking another neutral position N2 shown in FIG. 2(*b*) which is deviated somewhat toward the support pin 16 from the neutral position N1 shown in FIG. 2(*a*).

In the state shown in FIG. 2(*a*), the stick lever 3 can be moved in the same amount in both directions. When a position at which the arm member 15 is mounted on the mounting member 2 is varied as shown in FIG. 2(*b*), a range in which the stick lever 3 is operated in a right-hand direction is increased, whereas that in which it is operated in a left-hand direction is decreased. Thus, the illustrated embodiment facilitates a change in the neutral position as shown in FIGS. 2(*a*) and 2(*b*) because it is merely required to shift the position of the arm member 15 with respect to the support pin 16.

Now, force required for operating the stick lever 3 will be described hereinafter.

First, it is considered that moment applied to the arm member 15 by the spring 17 is kept substantially constant irrespective of slight movement of the support pin 16.

In the state shown in FIG. 2(*a*), force required for operating the stick lever 3 is kept constant irrespective of a direction of the operation. More particularly, the force is set so as to permit a ratio between force applied from the arm member 15 to the projection A and that applied to the projection B therefrom to coincide with a ratio of an interval between the pivotal shaft 8 and the projection A to that between the pivotal shaft 8 and the projection B.

When the neutral position is shifted as shown in FIG. 2(*b*), force applied from the arm member 15 to the projection A is reduced in the case that the stick lever 3 is operated in a right direction in FIG. 2(*b*), so that force required for operating the stick lever 3 may be reduced because the interval between the pivotal shaft 8 and the projection A is not varied.

On the contrary, if an interval between the shaft hole 13 and the projection B is equal to that between the shaft hole 14 and the projection C, operation of the stick lever 3 in a left direction in FIG. 2(*b*) causes force applied from the arm member 15 to the projection C to be substantially equal to force applied to the projection B in FIG. 2(*a*). An interval between the pivotal shaft 8 and the projection C is defined to be larger than the interval between the pivotal shaft 8 and the projection B, so that it is required to increase force for operating the stick lever 3 in the left direction in FIG. 2(*b*) as compared with that in FIG. 2(*a*).

Thus, in the illustrated embodiment, a change in the neutral position permits the operation in a direction in which an operation range is increased to be carried out by relatively small force and the operation in a direction in which the operation range is decreased requires relatively large force, so that operability by the stick lever 3 may be significantly improved.

In the embodiment described above, the position at which the arm member 15 is mounted on the mounting member 2 is varied to vary the abutment between the arm member 15 and the three projections A, B and C, to thereby shift the neutral position of the pivotal operation section 9. Alternatively, the stick lever device of the present invention may be constructed in such a manner that the shaft holes 13 and 14 are deviated so as to cause a gradient of the line formed by connecting each of the shaft holes and the pivotal shaft 8 of the stick lever to each other to be varied. Such construction permits a change in the neutral position of the pivotal operation section to be carried out through only two projections. Also, arrangement of a plurality of shaft holes on the same line as the pivotal shaft causes a position of abutment between the arm member and the projections to be varied. Therefore, when a shape of the arm member is changed correspondingly, only two projections are required for changing the neutral position of the pivotal operation section.

Further, the arm member may be mounted on the mounting member at any one of three or more positions, resulting in providing the pivotal operation section with three or more neutral positions.

As can be seen from the foregoing, the stick lever device of the present invention is so constructed that the arm member which is pivotally mounted on the mounting member at any one of different positions presses the projections of the pivotal operation section to set the pivotal operation section at the neutral position. Such construction eliminates a necessity of providing a change-over lever required in the prior art, to thereby reduce the number of parts constituting the stick lever device. Also, it facilitates assembling of the stick lever device. Further, it permits the neutral position of the stick lever to be readily shifted by merely changing a position at which the arm member is mounted on the mounting member.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A stick lever device comprising:

a mounting member provided on a rear side thereof with a pair of mounting brackets with a through-hole being interposed therebetween;

a variable resistor including a pivotal shaft and mounted on said mounting member;

a pivotal operation section including a stick lever and arranged on said pivotal shaft of said variable resistor;

said pivotal operation section being provided on a side surface thereof with a plurality of projections; and an arm member abutted against said projections by force of a predetermined magnitude to return said pivotal operation section to a predetermined neutral position;

said arm member being selectively pivotally mounted on said mounting member at any one of different positions so that abutment between said arm member and said projections may be varied to permit the neutral position of said pivotal operation section to be selected as desired.

2. A stick lever device as defined in claim 1, wherein said arm member is provided at a proximal end thereof with a support shaft which is adapted to be selectively engagedly fitted in one of shaft holes formed on one of said pair of mounting brackets of said mounting member.

3. A stick lever device as defined in claim 1, wherein said arm member is formed on a side thereof facing said mounting member with a first relief for said pivotal shaft;

two abutments in a manner to be aligned on a straight line with said first relief being interposed therebetween; and a second relief which is positioned between said support shaft and said abutment arranged in proximity to said support shaft.

4. A stick lever device as defined in claim 3, wherein said side surface of said pivotal operation section on which said plurality of projections are provided faces said arm member, and said plurality of projections are adapted to be abutted against said two abutments by elastic force of a spring.

5. A stick lever device as defined in claim 4, wherein one of said plurality of projections is arranged in proximity to the distal end of said arm member as compared with said pivotal shaft on a neutral position of said stick lever, while the remaining ones of said plurality of projections each are arranged in proximity to the proximal end of said arm member as compared with said pivotal shaft on the basis of the neutral position of said stick lever.

* * * * *